US005845815A

United States Patent [19]

Vogel

[11] Patent Number: 5,845,815

[45] Date of Patent: Dec. 8, 1998

[54] FLOW CONTROL FOR BEVERAGE DISPENSING VALVE

[75] Inventor: James D. Vogel, Anoka, Minn.

[73] Assignee: IMI Cornelius Inc., Anoka, Minn.

[21] Appl. No.: 706,728

[22] Filed: Sep. 6, 1996

Related U.S. Application Data

[60] Provisional application No. 60/003,648, Sep. 8, 1995.

[51] Int. Cl.[6] ..... B67D 5/56

[52] U.S. Cl. ..... 222/129.1; 137/504

[58] Field of Search ..... 222/129.1, 134, 222/564, 496, 497, 559; 137/504

[56] References Cited

U.S. PATENT DOCUMENTS

| | | | |
|---|---|---|---|
| 3,966,091 | 6/1976 | Bencic | 222/129.1 |
| 4,535,917 | 8/1985 | Trewhella | 222/129.1 |
| 4,932,564 | 6/1990 | Austin et al. | 222/129.1 |
| 5,269,442 | 12/1993 | Vogel | 222/129.1 |
| 5,607,083 | 3/1997 | Vogel et al. | 222/129.1 |

*Primary Examiner*—Philippe Derakshani
*Attorney, Agent, or Firm*—Sten Erik Hakanson

[57] ABSTRACT

A piston based flow control is shown for use in a high flow beverage dispensing valve. The piston thereof includes a top perimeter edge structure that allows for continuity of liquid flow during high flow applications and particularly during the initiation of a high flow dispensing so as to eliminate chattering of the piston.

3 Claims, 5 Drawing Sheets

10
52
54
46
62
48
50
24
20
34
14
36
56
12
26
28
30
32
18
16
58
60
44
40

10
54
42
24
42
37
36
34
34
20
38
58
32
30
18
12
16
44
40

54
46
50
48
74
74
80
34
72
78
76
26
58
30
12
18
44
40
16

78
80
76
72
24
74
74
36
22
32

FLOW CONTROL FOR BEVERAGE DISPENSING VALVE

This a nonprovisional application based on copending provisional application Ser. No. 60/003,648, filed Sep. 8, 1995.

FIELD OF THE INVENTION

The present invention relates generally to flow controls used in post-mix beverage dispensing valves and, in particular, to piston type flow controls as used in such valves.

BACKGROUND OF THE INVENTION

Post-mix beverage dispensing valves are well known in the prior art and provide for the simultaneous mixing of a flat or carbonated water and a syrup component for the production of a finished beverage. Such valves have apparatus for correctly proportioning the two components, typically five parts water to one part concentrate, so that a finished drink of the desired ratio is re-constituted. The post-mixing strategy has the advantage of permitting the efficient lower cost shipment, by the beverage manufacturer, of only the syrup concentrate, as opposed to the higher cost associated with shipping a finished drink having a much larger volume and weight.

This post-mix approach has worked well for various beverages where the syrup does not contain any large particulate matter. However, natural fruit juice syrup concentrates, for example, can contain significant particulate matter representing fruit pulp, and the like, that can substantially impair the functioning of a post-mix dispensing valve. In particular, it has been found that the proper operation of the rationing apparatus can be negatively impacted by the juice pulp resulting in a reduced flow. Accordingly, it would be highly desirable to provide for a post-mix beverage dispensing valve wherein the rationing apparatus thereof is not impaired by the dispensing of particulate containing beverages.

A further problem with rationing apparatus, and in particular rationing apparatus of the piston type, concerns the operation thereof in high flow applications. At flow rates generally around three ounces per second and above, there exists a tendency, at the initiation of dispensing, for the higher liquid flow to force the flow control piston to over compress the spring such pistons are typically balanced by and work against. This over compression causes the piston to move to a position where the flow is essentially stopped, after which the piston moves strongly in the opposite direction. As a result thereof, a movement can be induced wherein the piston starts to vibrate between two extreme positions. This type of operation is, over time, damaging to the flow control, can immediately impair the rationing operation thereof and can cause unwanted noise. Accordingly, it would also be desirable to have an improved flow control that does not have such vibratory piston motion under high flow applications.

SUMMARY OF THE INVENTION

The present invention comprises an improved rationing device of the piston type for use in a post-mix beverage dispensing valve. As is known in the art, such flow controls include a pair of chambers in separate fluid communication with a water and concentrate flavoring or syrup source respectively, on inlet bottom ends thereof. Each chamber has an outlet on a top end thereof for fluid communication with an on/off valve mechanism of the dispensing valve. The outflows form each flow control are then mixed together for dispensing in a suitable receptacle.

The flow controlling mechanism within the chamber in fluid communication with the water is the same as the mechanism in the other syrup regulating chamber and works in the same manner. Thus, for efficiency of description, just one generic control mechanism will be described. The flow control chamber includes a sleeve having a piston slideably positioned therein. The piston is biased by a spring held within the sleeve between the head end of the piston and a spring tensioning mechanism secured to a top end of the chamber. The head end of the piston is oriented downward towards the inlet end of the chamber and adjacent a bottom end of the sleeve. The opposite end of the piston has a skirt perimeter edge positioned adjacent the top end of the sleeve. The sleeve top end has a single hole extending there through for providing fluid communication between a piston central area and a sleeve outlet annular groove. The outlet annular groove is, in turn, in fluid communication with the chamber outlet. The bottom of the sleeve has an inlet annular groove in fluid communication with the chamber inlet and the piston head. The piston head has a hole centrally there through providing for fluid communication between the lower annular groove and the piston central area.

In operation, a pressurized flow of a beverage constituent, such as water, is provided to the chamber inlet and flows against the piston head pushing the piston against the spring. Simultaneously, a portion of the water flows through the piston head central hole into the piston central area. For the water to flow to the chamber outlet and from there into, for example, a cup into which the completed beverage is being dispensed, it must flow through the single sleeve hole. As is understood in the art, the degree to which the piston skirt edge is moved to cover the area of the single hole as the piston moves against the spring determines the resultant outflow rate. Thus, the inflow and outflow reach a dynamic balance. In all such prior art post-mix piston type flow controls, the sleeve includes a plurality of holes, typically 4 to 6. By using one hole wherein the total hole square area is thus approximately ¼ to ⅙ of the typical total, all the flow pressure comes to bear on the single hole thereby providing for self cleaning thereof Specifically, any particulate matter lodged therein would quickly be pushed there through or not permitted to become so lodged in the first place. It was surprisingly discovered that use of a single sleeve hole in this manner provided for a piston type flow control that would work with high pulp juice consistently well over time. It was also surprisingly discovered that the single hole sleeve which provides much less flow outlet area, nevertheless did not impair the ability of a post-mix valve so equipped from providing the total desired flow rate for juice dispensing of 1.5 to 2.0 ounces per second based upon standard industry inlet pressures.

In a further embodiment of the present invention, the sleeve includes the normal plurality of 4 to 6 holes, however the piston skirt perimeter edge includes a notched area. In a high flow environment of generally above 3 ounces per second, the notch was found to prevent the damaging vibratory motion that can occur in such high flow applications. It is believed that the notch provides for at least one of the sleeve holes from being completely blocked by the piston skirt edge, even at start-up under high flow conditions. Thus, a flow is maintained through the flow control mechanism even at the first initiation of dispensing. It is thought that a strong reaction in the other direction is prevented because the flow is not completely cut off whereby some of the pressure is relieved. In this manner, the spring is not as strongly compressed and the rebounding reaction is not as great whereby the damaging vibratory motion is not allowed to initiate. In yet a further embodiment the piston skirt end is angled. This embodiment also minimizes unwanted vibratory motion. The angled end is also thought to leave one or more of the sleeve holes at least partially un-blocked under high flow start up conditions.

DESCRIPTION OF THE DRAWINGS

A better understanding of the structure, function and objects and advantages of the present invention can be had by reference to the following detailed description which refers to the following figures, wherein.

DETAILED DESCRIPTION

Figure 1:
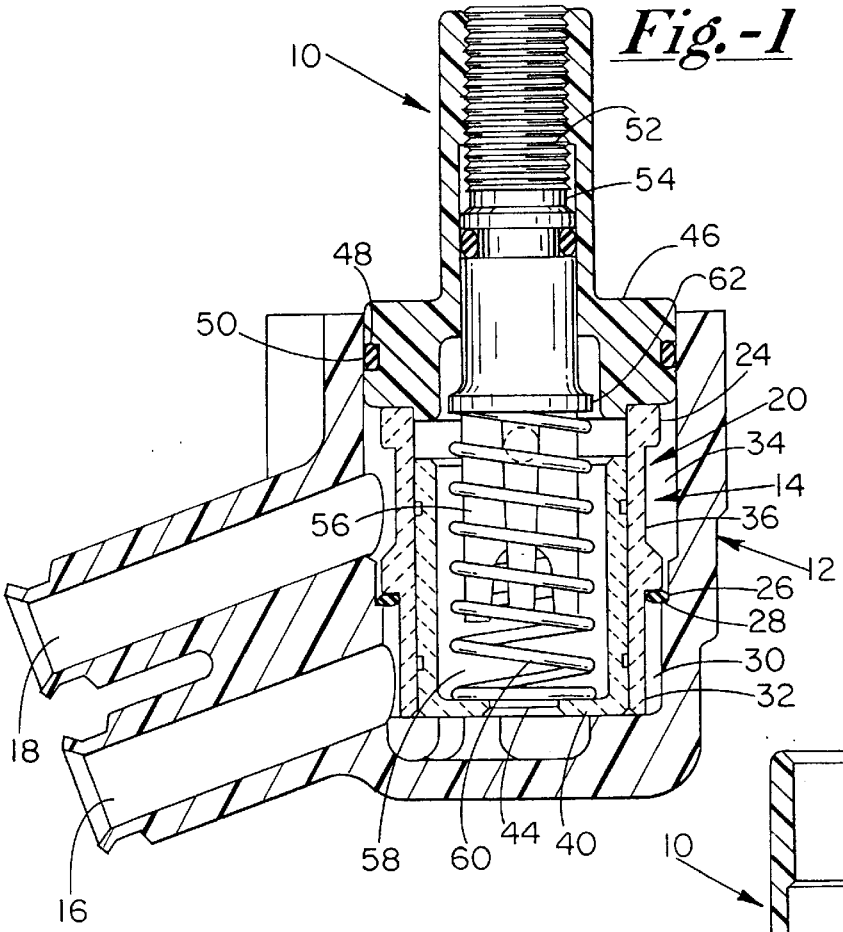
FIG. 1 shows a side plan cross-sectional view of a flow control embodiment of the present invention.
Figure 2:
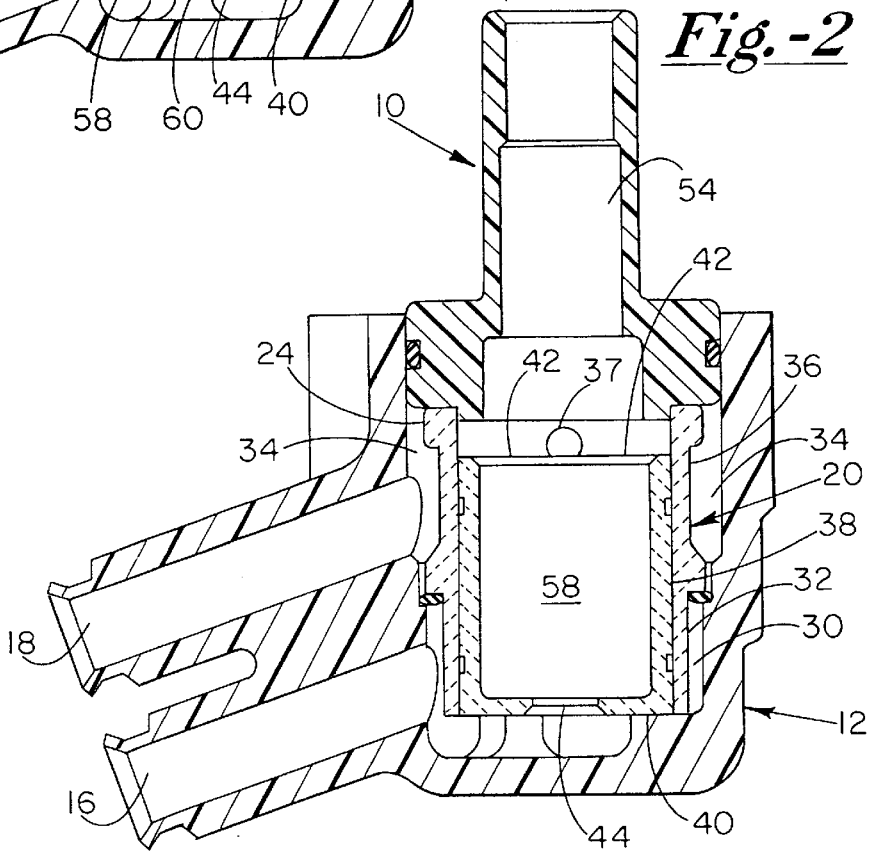
FIG. 2 shows a side plan cross-sectional view of the same embodiment of FIG. 1 where known components shown in FIG. 1 have been removed.
Figure 3:
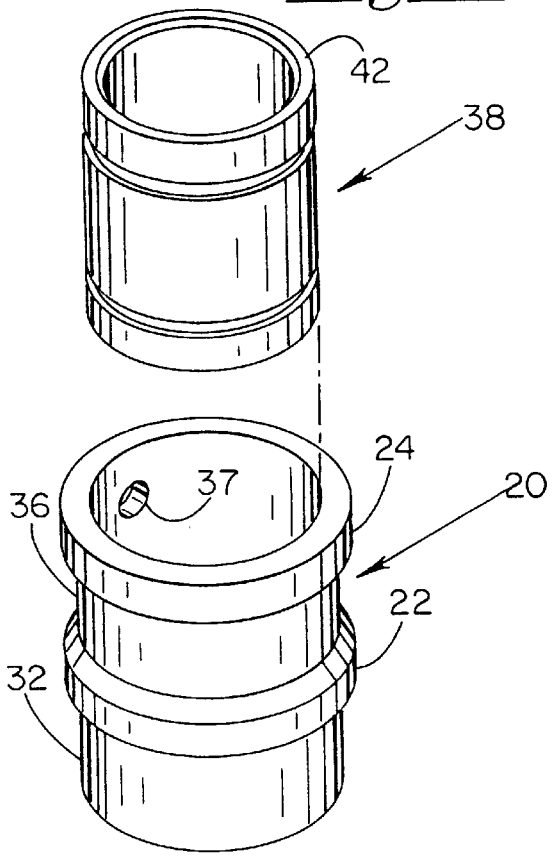
FIG. 3 shows an enlarged perspective exploded view of the piston and sleeve of FIG. 2 of the present invention.
Figure 4:
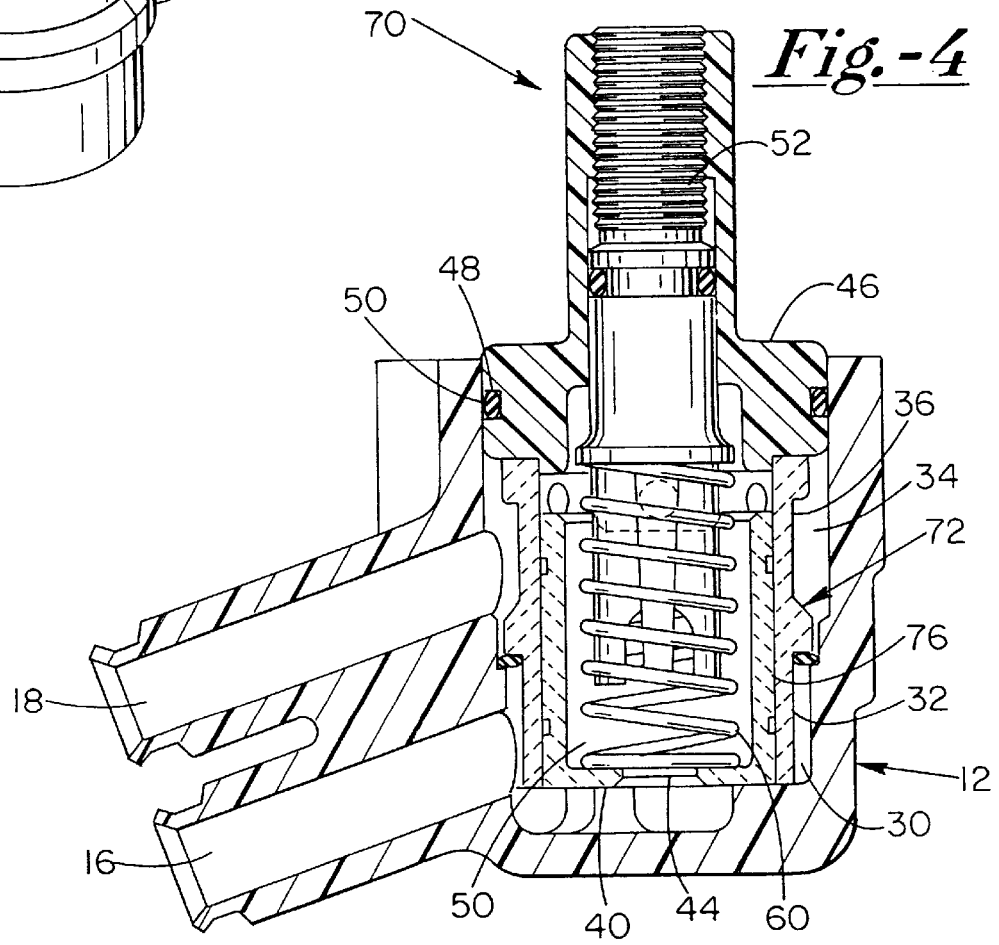
FIG. 4 shows a side plan partial cross-sectional view of a second flow control embodiment of the present invention.
Figure 5:
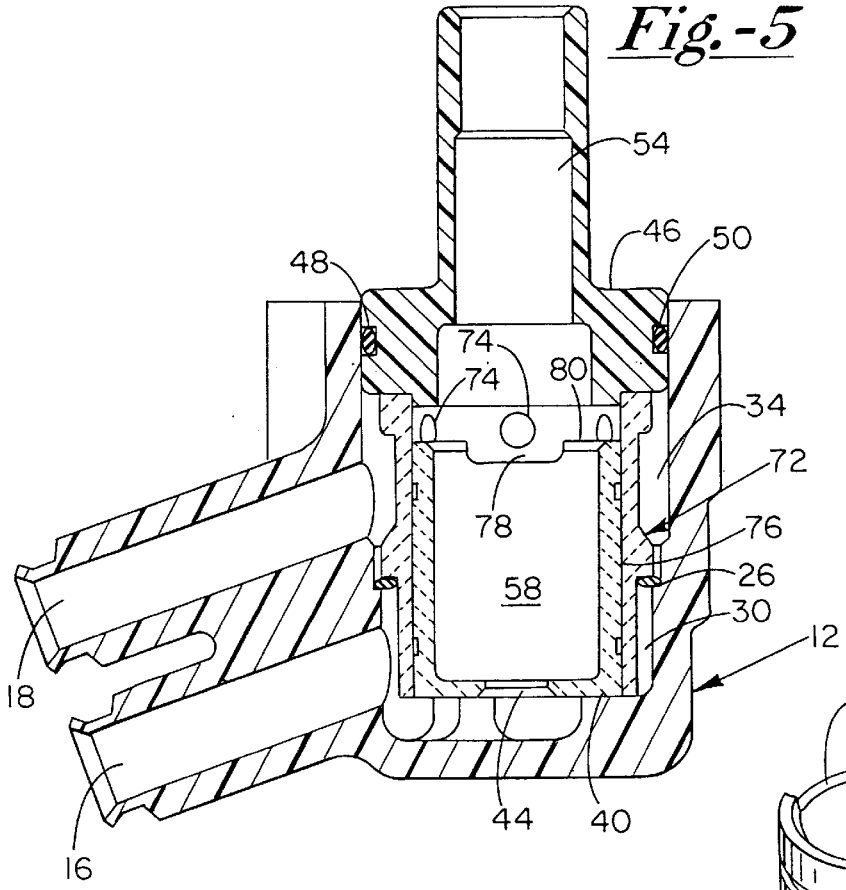
FIG. 5 shows a side plan cross-sectional view of the same embodiment of FIG. 4 where known components shown in FIG. 4 have been removed.
Figure 6:
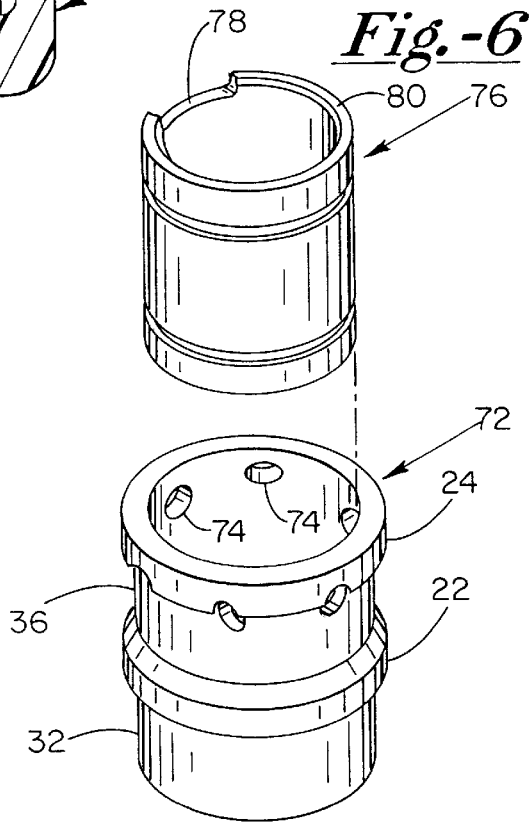
FIG. 6 shows an enlarged perspective exploded view of the piston and sleeve of FIG. 5 of the present invention.

A flow control 10 of the present invention can be understood by referring to FIGS. 1–3. Control 10 includes an outer housing 12 defining a mechanism retaining chamber 14 and an inlet 16 and an outlet 18. A sleeve 20 is received in chamber 14 and includes a middle annular ridge 22 and a top perimeter ridge 24. Ridge 22 cooperates with an o-ring 26 and a shoulder 28 to define a lower annular space 30 between housing 12 and a lower end 32 of sleeve 20. An upper annular space 34 is defined between an upper portion 36 of sleeve 20 and housing 2. Sleeve 20 includes a single hole 37 extending partially through perimeter ridge 24 and upper portion wall 36.

A piston 38 is slideably received within sleeve 20 and includes a piston head 40 and a top perimeter skirt edge 42. A hole 44 extends centrally of, and through piston head 40. A retaining plug 46 includes an annular groove 48 for retaining an o-ring 50 for providing fluid tight sealing of plug 46 when inserted into chamber 14. Plug 46 includes a tension adjustment means 52 includes an o-ring 53 and is threadably retained within and along a central axial bore 54 thereof. Adjustment means 52 includes a spring retaining extension 56 that extends into a central area 58 within piston 38. A spring 60 is retained within area 58 wherein extension 56 extends centrally thereof, and wherein, one end of spring 60 pushes against piston 38 and the other end thereof pushes against an annular ridge 62 of adjustment means 52.

In operation, fluid flows into inlet 16 and then into annular space 30. The fluid then flows to piston head 40 pressing there against, moving piston 38 to compress spring 60. Simultaneously, some of the fluid flows through hole 44 and into central area 58. The fluid can then flow through sleeve hole 37, into annular space 34 and ultimately to outlet 18. However, as a result of the movement of piston 38 caused by the force of the fluid against head 40, skirt edge 42 moves to progressively block off, that is, moves to cover, hole 37. In this manner the amount of fluid that is permitted to flow through hole 37 is related to how much of hole 37 is left uncovered. The amount so uncovered is a function of the resistance to compression of spring 60. Moreover, as is understood by those of skill, such resistance can be adjusted by the position of adjustment means 52. Thus, by screwing adjustment means 52 so that extension 56 moves further into area 58, the resistance force of spring 60 can be increased by the resulting compression thereof. Conversely, such tension can be decreased by moving extension 56 in the opposite direction. Therefore, a desired outflow rate can be achieved by a dynamic balance between the resistance to compression of spring 60 and the flow pressure of the inlet fluid. Furthermore, changes in the inlet pressure, within a certain range can be adjusted for automatically to maintain the same desired net outflow rate. For example, a lower inflow pressure will move piston 38 a proportionately smaller distance against spring 60 whereby a larger proportion of hole 37 will remain unobstructed so that more fluid is allowed to flow to outlet 18. Thus, as is known in the art, flow control 10 is self compensating.

The foregoing concerns the known operational aspects of piston type flow controls. Typical controls of this type have four to six holes in the sleeve thereof as opposed to the one hole 37 of the present invention. Such plurality of holes was thought to provide for an adequate outflow of fluid given the size restraints on such controls where the diameter of the mechanism retaining chamber thereof and of the present invention can be between 2.0 to 2.5 cm, and where such holes can have a diameter of approximately 0.2 cm. Given such sizing, it could be predicted that such flow controls may have difficulty rationing a liquid having a particulate matter content, such as pulp containing fruit juice concentrate. For example, the many small channels and orifices of such controls can potentially become plugged, or the piston movement could become impeded by such particles. In fact, the multiple hole prior art flow controls were found to deteriorate in operation when called upon to ratio pulp containing fruit juice concentrate. However, it was not known specifically what the cause for the poor performance could be attributed to, as disassembly and cleaning of such controls proved inconclusive. It was surprisingly discovered that in the control 10 of the present invention where there exists only one such sized sleeve hole, that a resultant flow rate of approximately 1.5 ounces per second could be achieved with conventional inlet pressures. It was even further surprisingly discovered that flow control 10 would not be rendered inoperative when used to ratio a pulpy fruit juice concentrate. It is believed that the use of a single hole 37 requires all the flow pressure to come to bear at that point, whereby the particulate matter is prevented form collecting or blocking hole 37. Thus, it was discovered that the plurality of sleeve holes were the main source of difficulty, as opposed other orifices becoming clogged or the piston travel being affected.

A second embodiment 70 can be understood by referring to FIGS. 4–7. For convenience, the same numbers are used to indicate the same parts as in the previously described embodiment. Control 70 is the same as control 10 except that it includes a standard sleeve 72 having a plurality of holes 74 and a modified piston 76. Piston 76 includes a notch or recess 78 extending along a portion of a perimeter edge 80 thereof. In operation, control 70 works essentially as described for control 10. However, control 70 is designed for operating under high flow conditions of approximately 3 ounces per second and above. In such an environment, control 70 is much less susceptible to the chattering or vibration that can occur with conventional piston flow controls. At the higher flow rates it is believed that the initial in-rush of fluid can cause the piston to completely block the sleeve holes so that the pressure is not relieved by an outflow of liquid. Eventually, the spring can overcome this initial compression but, in the sense of an equal and opposite reaction, can move the piston in the opposite direction to cause a large flow of liquid which, in turn, moves the piston back in the other direction whereby the process is repeated. In any event, a vibratory or oscillating motion is imparted to the piston that can be damaging to the flow control and cause unwanted noise. It is believed that recess 78 serves to provide for at least one of the holes 74 being at least partially un-blocked even at the initiation of dispensing at a high flow rate, regardless of the orientation of piston 76 in sleeve 72. In this manner, a small out flow is maintained at start-up, as piston 76 can not travel enough so that recess 78 is pushed beyond holes 74 as edge 80 will first contact plug 46. Thus, there appears to be some pressure relief at all times, even at initiation of flow, whereby control 70 is much less susceptible to the initiating of such damaging vibratory action.

Figure 7:
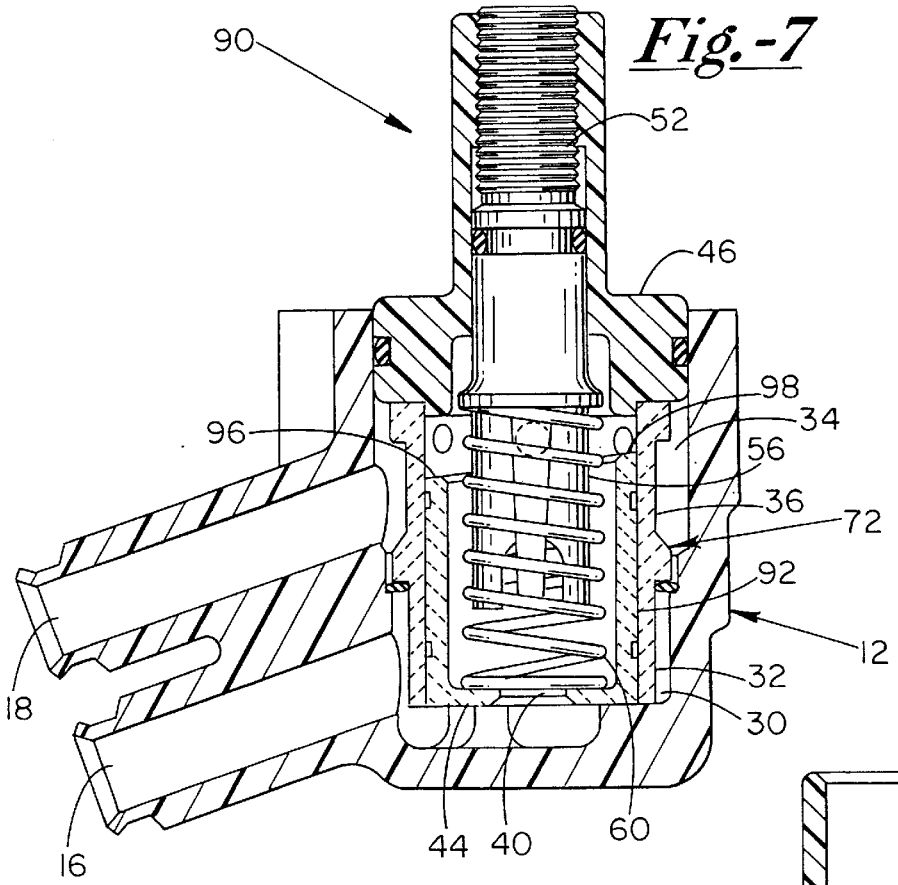
FIG. 7 shows a side plan partial cross-sectional view of a third flow control embodiment of the present invention.
Figure 8:
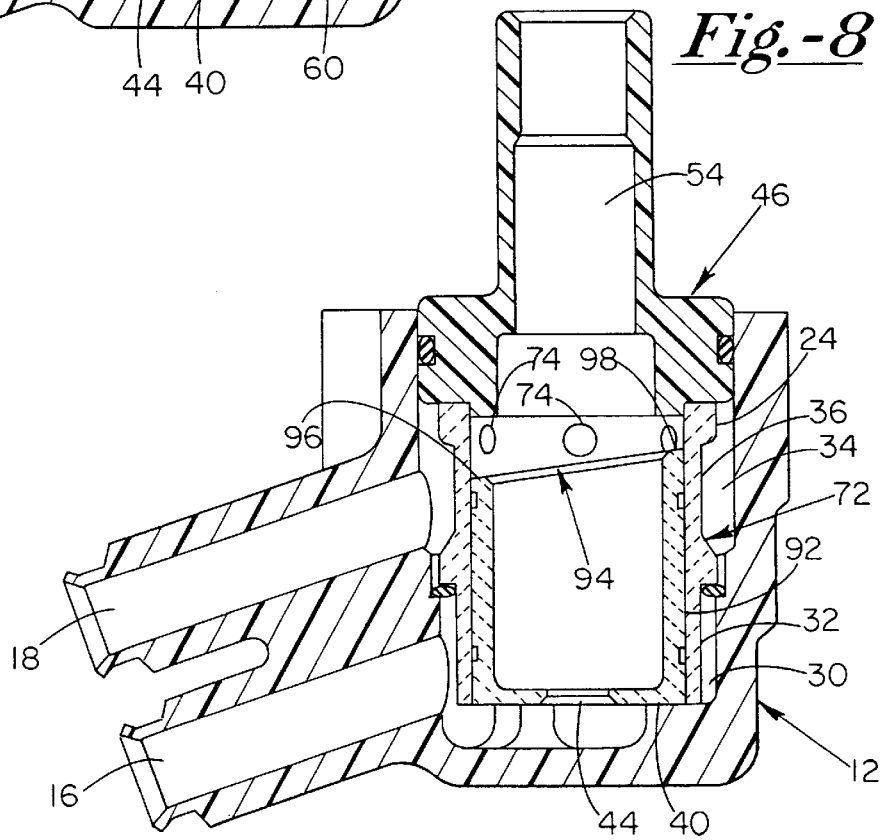
FIG. 8 shows a side plan cross-sectional view of the same embodiment of FIG. 7 where known components shown in FIG. 7 have been removed.
Figure 9:
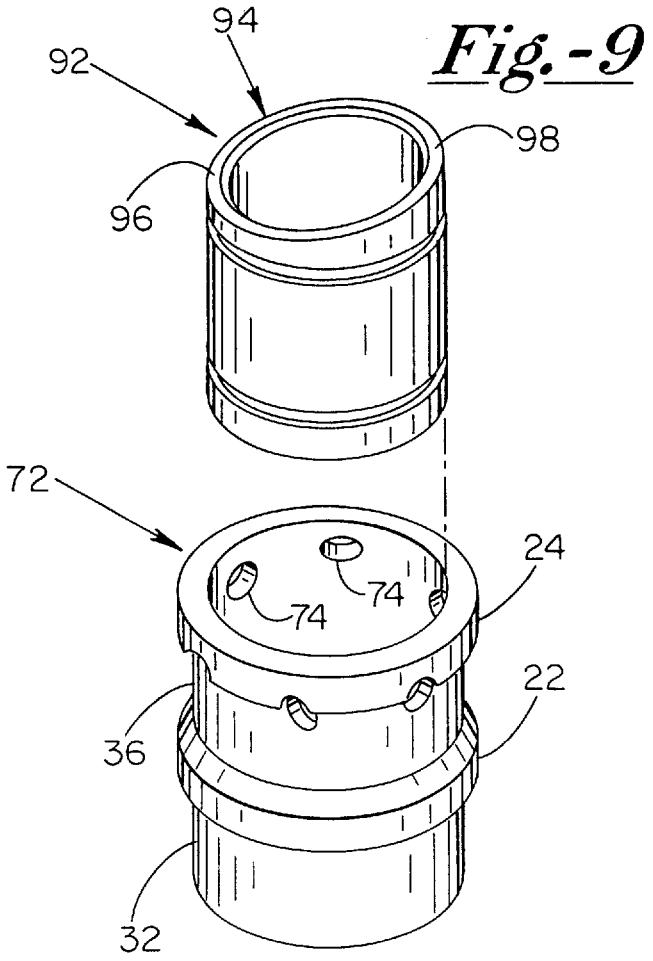
FIG. 9 shows an enlarged perspective exploded view of the piston and sleeve of FIG. 8 of the present invention.

A third embodiment is seen in FIGS. 7–9, and referred to by the numeral 90. Control 90 is the same as control 70 except that it includes a modified piston 92. Piston 92 includes an angled top perimeter edge 94 having a low point 96 and a high point 98.

In operation, control 90 works the same as control 70 and according to a similar theory. As with piston 76, piston 92 provides for a fluid flow even at initiating of dispensing at high flow rates. Piston 92 is designed so that at such initiation of flow, low point 96 can not travel past the level of holes 74 as high point 98 will first contact plug 46. Thus, at least one of holes 74 is thought to be open, at least partially, at all times, including at flow initiation. Thus, flow control 90 is also resistant to the vibratory action found in conventional piston type flow controls operating in high flow environments.

It is claimed:

1. A flow control, for a beverage dispensing valve, comprising:

a housing defining a piston chamber, the chamber having an inlet and an outlet, a piston sleeve held within the chamber having an inlet end adjacent the chamber inlet and an outlet end adjacent the chamber outlet, a piston slideably retained in the sleeve, the piston having a first piston head end and a skirt end opposite therefrom and the skirt end ending in a perimeter edge, the perimeter edge oriented in a direction towards the sleeve outlet end, and the perimeter edge having a recessed portion thereof existing at a level below a top level thereof, and the sleeve having one or more holes there through adjacent the outlet end thereof, biasing means for biasing the piston head end in a first direction towards the chamber inlet so that a flow of beverage against the piston head end causes the piston skirt end to move towards the one or more sleeve holes whereby the flow of beverage to the chamber outlet is regulated as a function of the degree of covering of the one or more holes by the piston skirt end and whereby the recessed portion provides for at least one of the one or more holes remaining at least partially uncovered by the piston skirt end during periods of high beverage flow.

2. The flow control as defined in claim 1, and the recessed portion comprising a notch therein and extending along a portion thereof.

3. The flow control as defined in claim 1, wherein the perimeter edge extends at an angle transverse to the extension of the piston head end thereby defining a perimeter edge low point and a high point whereby the recessed portion extends through and on either side of the low point.

* * * * *